US005575738A

United States Patent [19]

Millington et al.

[11] Patent Number: 5,575,738

[45] Date of Patent: Nov. 19, 1996

[54] EXERCISE AND PLAY APPARATUS

[75] Inventors: Charles J. Millington, Lakeville, Mass.; Melissa M. Morgan, Little Compton, R.I.

[73] Assignee: Hasbro, Inc., Pawtucket, R.I.

[21] Appl. No.: 489,469

[22] Filed: Jun. 12, 1995

[51] Int. Cl.[6] ..... A63B 5/11

[52] U.S. Cl. ..... 482/35; 482/27; 482/77; 472/135

[58] Field of Search ..... 446/220, 221; 5/449, 455, 99.1, 98.1; 52/2.11, 2.22; 482/27, 35, 148; 441/40, 41; 472/134, 135, 130

[56] References Cited

U.S. PATENT DOCUMENTS

| | | | |
|---|---|---|---|
| 1,738,411 | 12/1929 | Welch . | |
| 2,718,014 | 9/1955 | Mizrack et al. | 5/98.1 |
| 2,978,243 | 4/1961 | Gabrielson . | |
| 3,460,828 | 8/1969 | Curlee . | |
| 4,077,623 | 3/1978 | Clausell . | |
| 4,815,153 | 3/1989 | Blesser et al. | 5/93 R |

FOREIGN PATENT DOCUMENTS

| | | | |
|---|---|---|---|
| 36070 | 11/1965 | Germany | 4/585 |
| 0625129 | 6/1949 | United Kingdom | 441/40 |
| 2257370 | 1/1993 | United Kingdom | 472/135 |

*Primary Examiner*—Jerome Donnelly
*Attorney, Agent, or Firm*—Morgan & Finnegan

[57] ABSTRACT

An exercise and play apparatus includes inflatable bottom and sidewall portions, each of which includes a plurality of independently inflatable compartments. The bottom wall has a thickness of at least approximately ten inches and the sidewall extends upwardly from the bottom wall by at least approximately ten inches. The sidewall and bottom wall cooperate to define an enclosed play area in which users can perform jumping and bouncing activities.

12 Claims, 4 Drawing Sheets

EXERCISE AND PLAY APPARATUS

BACKGROUND AND SUMMARY OF THE INVENTION

The instant invention relates to recreational and exercise apparatus and more particularly to an inflatable device which can be effectively utilized by children in a manner similar to a trampoline.

It has generally been found that exercise apparatus, such as trampolines, which have sufficient resilience to allow users to perform jumping or bouncing exercises thereon, have significant levels of appeal. However, it has also been found that the heretofore available devices of this type are not always safe for unsupervised use by relatively young children. On the other hand, inflatable exercise and play apparatus have generally been found to have significant levels of appeal with young children, although the heretofore available inflatable apparatus have generally not been adapted to permit youthful users thereof to perform the types of bouncing or jumping activities normally associated with trampolines. The instant invention, however, provides an effective inflatable apparatus which is adapted to enable users to safely perform a variety of bouncing and/or jumping activities thereon as will hereinafter be more fully set forth.

Devices representing the closest prior art to the subject invention of which the Applicants are aware are disclosed in the U.S. Pat. Nos. to Welch, 1,738,411; Gabrielson, 2,978,243; Curlee, 3,460,828; and Clausell, 4,077,623. However, while these references disclose a variety of different types of exercise devices for users of different ages, they fail to provide an effective inflatable device which is adapted to permit users to safely perform jumping and bouncing activities thereon similar to those normally performed on trampolines. The only other previously known devices of the general type under consideration comprise inflatable platforms which are used for performing jumping and bouncing activities at carnivals and the like. However, these devices have generally included sidewalls made from open mesh netting rather than including inflatable sidewalls of the type utilized in the device of the subject invention, and hence, these previously known devices are also believed to be of only general interest with respect to the subject invention.

The instant invention provides an effective exercise and play apparatus which is adapted to enable youthful users to safely perform various bouncing and jumping activities thereon. Specifically, the exercise and play apparatus of the instant invention comprises an inflatable bottom wall made of flexible airtight sheet material and an inflatable sidewall which extends upwardly from the bottom wall for defining the perimeter of an enclosed upwardly open central play area thereon. The bottom wall comprises a plurality of inflatable compartments, and it is inflatable to an average thickness of at least approximately ten inches in order to permit a user to jump and bounce thereon in a manner similar to a user of a trampoline. The sidewall preferably also comprises a plurality of inflatable compartments, and it extends upwardly from the bottom wall by at least approximately ten inches to provide a cushioned perimeter wall around the play area. The bottom wall and the sidewall are preferably of circular configuration and concentrically oriented, and the compartments in the bottom wall and sidewall are preferably independently inflatable. Further, the compartments in the sidewall are preferably formed as tubular circular compartments which are disposed one above another and extend around the play area. The compartments in the bottom wall are preferably also concentrically oriented, and both the bottom wall and the sidewall are preferably made from a relatively heavy gauge durable vinyl sheet material. Further, both the bottom wall and the sidewall preferably each comprise at least three independently inflatable compartments.

It has been found that the apparatus of the instant invention can be effectively utilized by children of various ages as an effective and exciting exercise and play apparatus. In this regard, because the bottom wall of the apparatus is inflatable to an average thickness of at least approximately ten inches, children of various weights and sizes can effectively jump and bounce thereon without collapsing the bottom wall to a point where contact is made with a supporting surface therebeneath. Further, because the bottom wall includes a plurality of independently inflatable compartments, the bottom wall remains firm during bouncing and jumping activities and is further prevented from collapsing to a point where contact is made with a supporting surface therebeneath. Still further, because the sidewall extends upwardly by at least ten inches from the bottom wall, the sidewall provides an effective cushioned retaining wall structure for containing one or more children in the play area on the bottom wall during jumping or bouncing activities.

Accordingly, it is a primary object of the instant invention to provide an effective inflatable exercise and play apparatus which is adapted for use by young children in the performance of various jumping and bouncing activities.

Another object of the instant invention is to provide an effective exercise and play apparatus comprising an inflatable bottom wall and an inflatable upstanding perimeter sidewall.

Another object of the instant invention is to provide an effective play apparatus comprising an inflatable bottom wall which is adapted to permit users to jump and bounce thereon.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
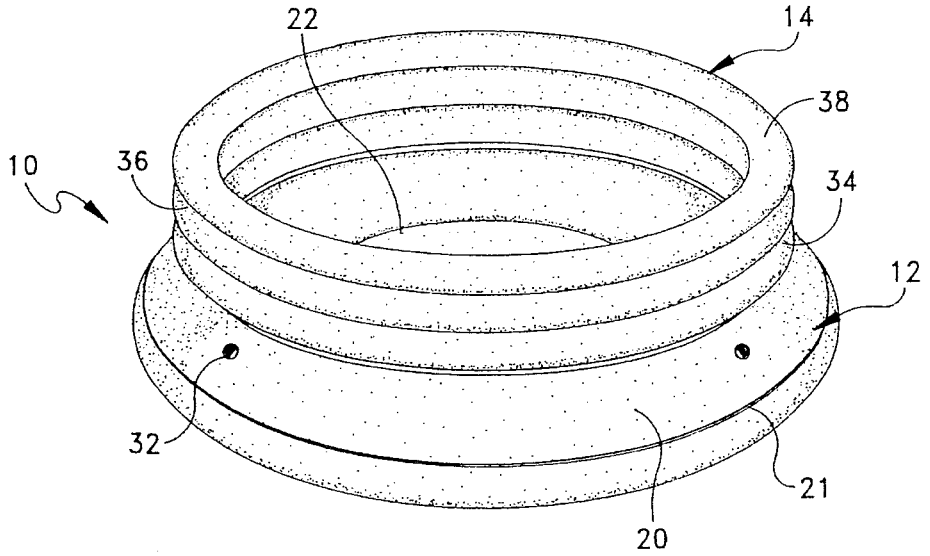
FIG. 1 is a perspective view of the exercise and play apparatus of the instant invention.
Figure 2:
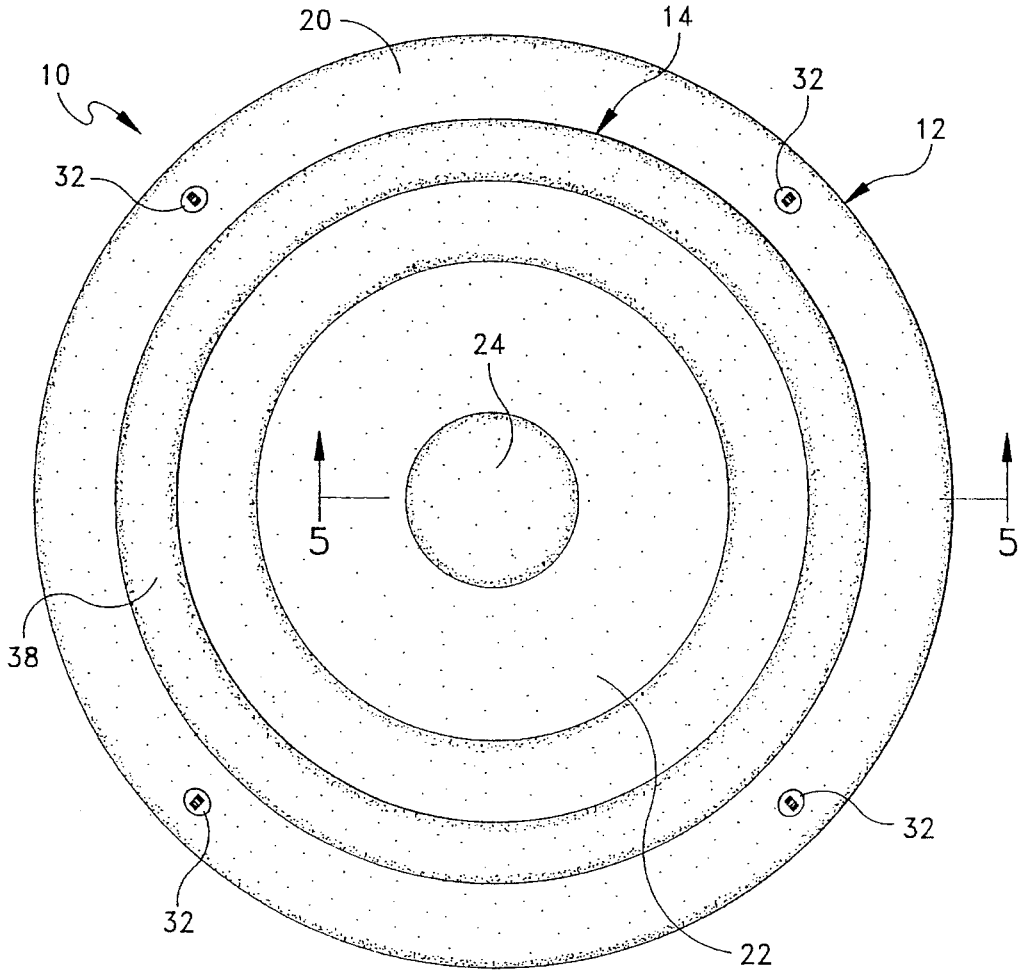
FIG. 2 is a top plan view thereof.
Figure 3:
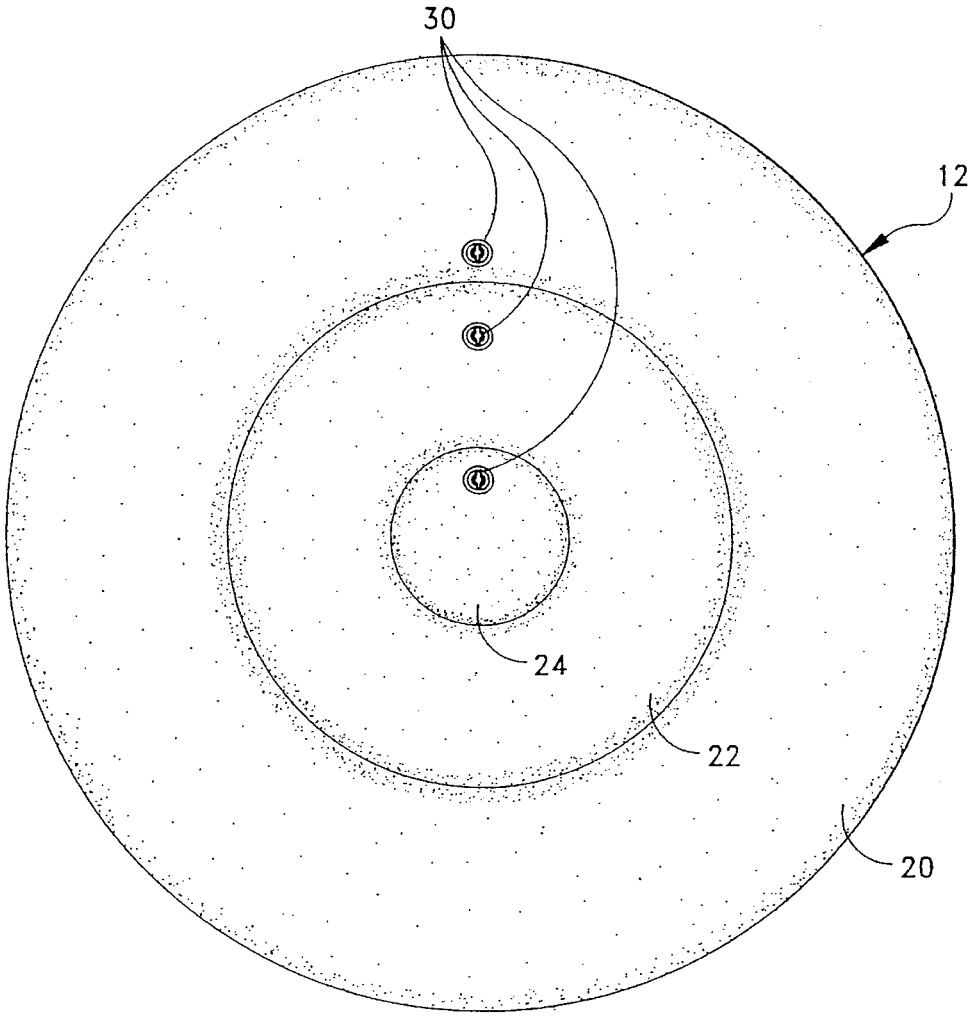
FIG. 3 is a bottom plan view thereof.
Figure 4:
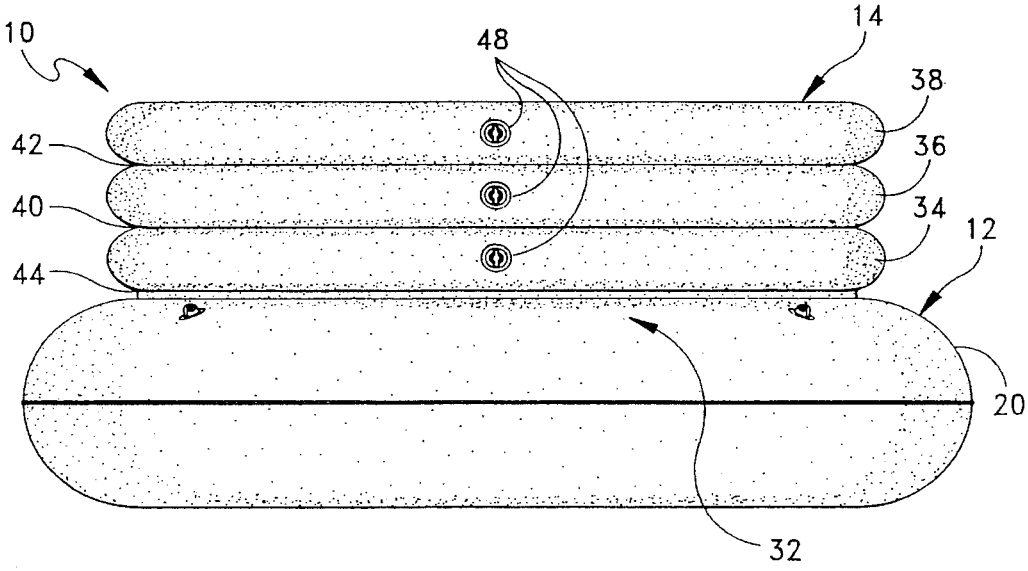
FIG. 4 is a side elevational view thereof.
Figure 5:
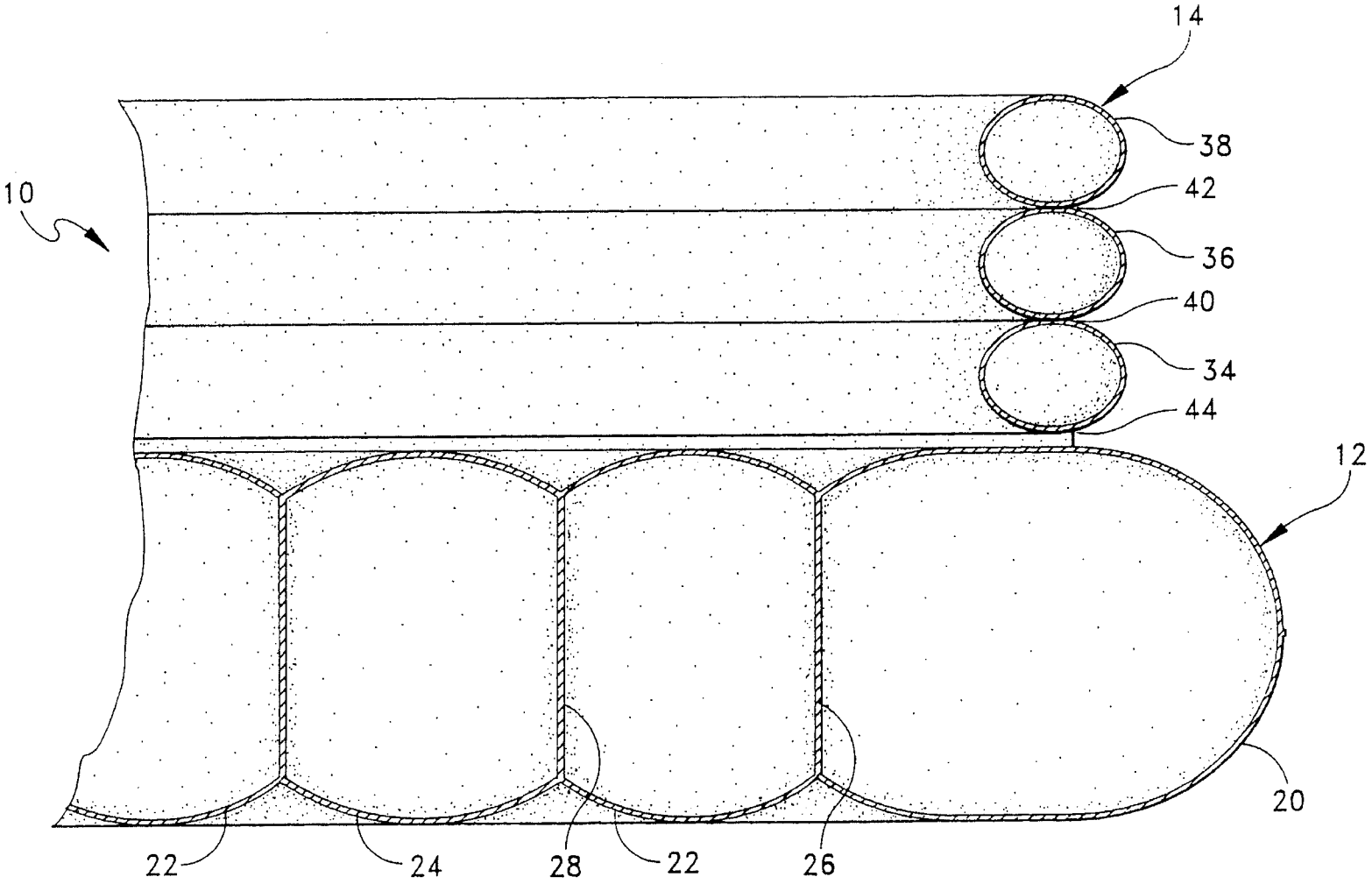
FIG. 5 is a sectional view taken along line 5—5 in FIG. 2.
Figure 6:
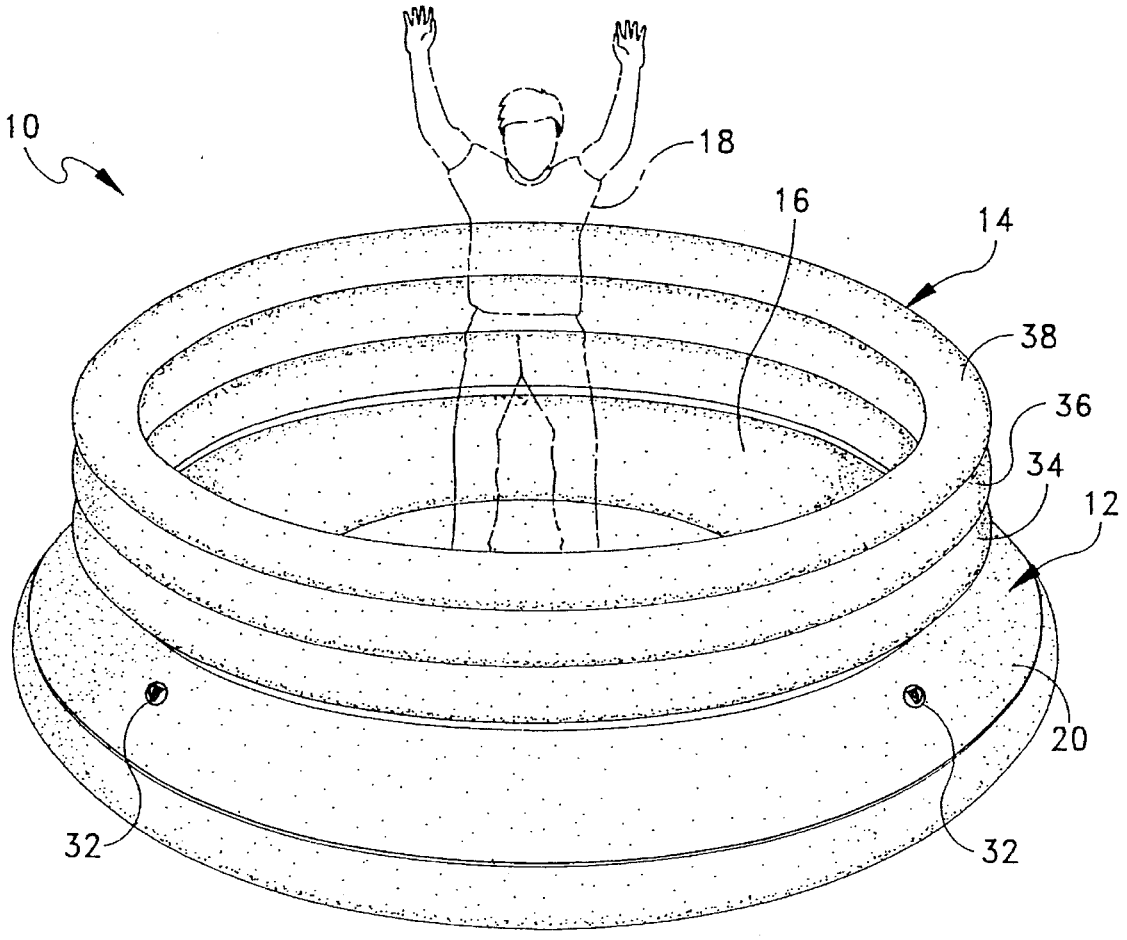
FIG. 6 is a perspective view of the apparatus as used by a user during a jumping exercise.

Referring now to the drawings, the exercise and play apparatus of the instant invention is illustrated in FIGS. 1–6 and generally indicated at 10 in FIGS. 1, 2 and 4–6. The apparatus 10 comprises a substantially circular inflatable bottom wall generally indicated at 12, and a substantially circular ring-shaped sidewall generally indicated at 14 which extends upwardly from the bottom wall 12. The bottom wall 12 and the sidewall 14 cooperate to define an open interior play area 16, and they are adapted for use in performing jumping or bouncing activities such as performed by a user 18 as illustrated in FIG. 6.

The bottom wall 12 comprises a plurality of concentric bottom wall sections 20, 22 and 24. The bottom wall sections 20, 22 and 24 are preferably made from a suitable, durable, relatively heavy gauge vinyl sheet material which is both airtight and resilient. Further, the bottom wall sections 20, 22 and 24 are preferably separated by partitions 26 and 28, and they are preferably independently inflatable through inflation nipples 30. In this regard, because the bottom wall sections 20, 22 and 24 are independently inflatable, the bottom wall 12 is more effectively capable of supporting one or more persons thereon without causing localized sections of the bottom wall to be fully collapsed under the weight of the persons. The bottom wall 12 is preferably constructed so that the bottom wall sections 20, 22 and 24 define an average thickness or height in the bottom wall of at least approximately ten inches and preferably as much as twenty inches when the bottom wall sections 20, 22 and 24 are fully inflated. The bottom wall also includes a plurality of tiedown loops 32 which are adapted for receiving tiedown cords in order to secure the apparatus 10 in a desired location.

The sidewall 14 is preferably also made from a suitable, durable heavy gauge vinyl sheet material which is both airtight and resilient. The sidewall 14 comprises three concentric ring-shaped tubular sections 34, 36 and 38. The tubular sections 34, 36 and 38 are preferably of substantially the same diameter and concentrically oriented on the bottom wall 12 so that the tubular sections 34, 36 and 38 extend upwardly from the outermost bottom wall compartment or section 20. The tubular sections 34, 36 and 38 are connected along seams 40 and 42, and the lowermost section 34 is attached to the bottom wall compartment 20 along a seam 44. The tubular sections 34, 36 and 38 are independently inflatable through inflation nipples 48, and they cooperate to define the sidewall 14 so that it extends upwardly by at least approximately ten inches around the perimeter of the play area 16. Further, because the sidewall 14 is defined by the tubular inflatable sections 34, 36 and 38, the sidewall 14 provides a cushioned containment member which extends around the perimeter of the open area 16. Also, because the sidewall 14 is defined by a plurality of independently inflatable sections, it is less prone to collapsing when the sidewall 14 is engaged by a user of the apparatus 10.

Accordingly, for use and operation of the exercise and play apparatus 10, the various sections of the bottom wail 12 and the sidewall 14 are inflated to pressures which render them reasonably firm without risking damage from over inflation. One or more users can then enter the play area 16 and jump, bounce, or crawl on the bottom wail 12. Because of the overall thickness of the bottom wail 12 and the fact that it comprises a plurality of independently inflatable compartments, it is possible for a user, such as the user 18, to bounce and jump on the bottom wail 12 without causing the bottom wall 12 to completely collapse in localized areas under the pressure created by the weight of the user 18. Accordingly, the user 18 can jump on the bottom wall 12 in a manner similar to a user of a trampoline. Further, during use of the apparatus 10 in this manner, the sidewall 14 acts as a cushioned retaining wall which prevents the user 18 from suffering injuries during a jumping exercise.

It is seen, therefore, that the instant invention provides an effective exercise and play apparatus. The bottom wall 10 provides an effective cushioned resilient jumping surface for a user, such as the user 18, and the sidewall 14 provides an effective cushioned perimeter wall for enclosing the play area 16 and protecting the user 18 against injuries. As a result of these features, the exercise and play apparatus 10 has been found to have a high level of play value and that it, therefore, represents a significant advancement in the art having substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An exercise and play apparatus comprising:

a substantially horizontally oriented, inflatable bottom wall having a perimeter, an upper surface and a lower surface, the upper and lower surfaces being spaced apart throughout the bottom wall, the bottom wall being made of a flexible airtight sheet material, said bottom wall including a plurality of inflatable compartments and being inflatable to an average thickness such that the upper and lower surfaces are spaced at least approximately ten inches apart in order to permit a user to jump and bounce on said upper surface of the bottom wall in a manner similar to a user of a trampoline; and a substantially vertically oriented inflatable sidewall made from a flexible airtight sheet material and extending upwardly from and continuously along the upper surface of said bottom wall, said sidewall defining a continuous perimeter of an enclosed, upwardly open central play area on said bottom wall and extending upwardly from said bottom wall by at least approximately ten inches to provide a cushioned perimeter wall around said play area.

2. In the exercise and play apparatus of claim 1, said bottom wall and said sidewall being circular and being concentrically oriented.

3. In the exercise and play apparatus of claim 1, said bottom wall compartments being independently inflatable.

4. In the exercise and play apparatus of claim 1, said sidewall comprising a plurality of independently inflatable compartments.

5. In the exercise and play apparatus of claim 4, said sidewall comprising a plurality of independently inflatable tubular compartments which are disposed one above another, each of said inflatable tubular compartments extending around said play area.

6. In the exercise and play apparatus of claim 1, said bottom wall and said sidewall being circular and being concentrically oriented, said bottom wall compartments being concentrically oriented and being independently inflatable, said sidewall comprising a plurality of inflatable tubular concentric ring-shaped compartments which are independently inflatable and disposed one above another so that said ring-shaped compartments cooperate to define an upstanding sidewall structure.

7. In the exercise and play apparatus of claim 6, said bottom wall and said sidewall being made of a vinyl sheet material and being independently inflatable.

8. In the exercise and play apparatus of claim 1, said sidewall being offset inwardly from said perimeter of the bottom wall.

9. In the exercise and play apparatus of claim 1, said sidewall having a substantially planar upper rim.

10. An exercise and play apparatus comprising:

an inflatable, substantially horizontally oriented bottom wall having an upper surface, a lower surface and a perimeter, the upper and lower surfaces being spaced apart throughout the bottom wall by a distance sufficient to generate a trampoline effect based on air pressure between the upper and lower surfaces; and an inflatable, substantially vertical oriented sidewall extending upwardly from and continuously along the upper surface of the bottom wall said sidewall defining a continuous perimeter of an enclosed, upwardly open central play area on said bottom wall and extending upwardly from said bottom wall to provide a cushioned perimeter wall around said play area, the sidewall having a height and thickness selected to retain, as well as cushion the impact of, users jumping on the upper surface of the bottom wall.

11. An exercise and play apparatus according to claim 10, wherein the sidewall is offset inwardly of the perimeter of the bottom wall.

12. An exercise and play apparatus comprising:

an inflatable, substantially horizontally oriented bottom wall having an upper surface, a lower surface and a perimeter, the upper and lower surfaces being spaced apart sufficiently to generate a trampoline effect based on air pressure in said bottom wall; and an inflatable, substantially vertically oriented continuing sidewall connected about the bottom wall and defining an enclosure with the sidewall having a height and thickness selected to retain, as well as cushion the impact of, users jumping or bouncing on the upper surface of the bottom wall.

* * * * *